US007710355B2

(12) United States Patent
Hur et al.

(10) Patent No.: US 7,710,355 B2
(45) Date of Patent: May 4, 2010

(54) PLASMA DISPLAY PANEL

(75) Inventors: Min Hur, Yongin-si (KR); Jeong Doo Yi, Yongin-si (KR); Hak Cheol Yang, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 904 days.

(21) Appl. No.: 11/489,930

(22) Filed: Jul. 19, 2006

(65) Prior Publication Data

US 2007/0171174 A1 Jul. 26, 2007

(30) Foreign Application Priority Data

Jul. 20, 2005 (KR) ..... 10-2005-0065858

(51) Int. Cl.
*G09G 3/28* (2006.01)
*G09G 3/10* (2006.01)
*H01J 17/49* (2006.01)

(52) U.S. Cl. ..... 345/60; 345/41; 315/169.4; 313/582

(58) Field of Classification Search ..... 345/33, 345/37, 41, 60–72; 313/582–587; 315/169.1, 315/169.4
See application file for complete search history.

(56) References Cited

U.S. PATENT DOCUMENTS 5,150,007 A 9/1992 Andreadakis
5,714,840 A 2/1998 Tanabe et al.
6,008,582 A 12/1999 Asano
6,608,609 B1 * 8/2003 Setoguchi et al. ..... 345/60
6,686,912 B1 * 2/2004 Kishi et al. ..... 345/211
7,471,044 B2 * 12/2008 Woo et al. ..... 313/586
7,508,135 B2 * 3/2009 Kang et al. ..... 313/582
2002/0047584 A1 4/2002 Rutherford
2002/0109650 A1 8/2002 Kougami et al.
2002/0140639 A1 10/2002 Sakita
2003/0173899 A1 9/2003 Toyoda et al.
2004/0150354 A1 8/2004 Setoguchi et al.
2004/0245929 A1 * 12/2004 Sakamoto ..... 313/584
2005/0127838 A1 6/2005 Amano
2005/0231112 A1 * 10/2005 Woo et al. ..... 313/582
2006/0001377 A1 * 1/2006 Hur et al. ..... 313/584

FOREIGN PATENT DOCUMENTS

EP 1 227 465 A3 4/2007

OTHER PUBLICATIONS

European Search Report dated Nov. 20, 2006, for 06117106.2, in the name of Samsung SDI Co., Ltd.

* cited by examiner

*Primary Examiner*—Srilakshmi K Kumar
(74) *Attorney, Agent, or Firm*—Christie, Parker & Hale, LLP

(57) ABSTRACT

A plasma display panel includes first display electrodes and second display electrodes positioned inside barriers while opposing each other. A front panel has closed-type barriers to increase fluorescent substance application area. A rear panel has stripe-type barriers to lower address voltage between the first display electrodes and address electrodes and improve emission efficiency by means of long-gap discharge. The plasma display panel uses trigger discharge during address discharge and sustain discharge to lower discharge voltage.

20 Claims, 7 Drawing Sheets

PLASMA DISPLAY PANEL

CROSS REFERENCE TO RELATED APPLICATION

This application claims priority to and the benefit of Korean Patent Application No. 10-2005-0065858, filed Jul. 20, 2005 in the Korean Intellectual Property Office, the entire content of which is incorporated herein by reference.

BACKGROUND OF THE INVENTION

1. Field of the Invention

The present invention relates to a plasma display panel, and more particularly to a plasma display panel having increased fluorescent substance application area, lower discharge initiation voltage between first display electrodes and address electrodes, and improved emission efficiency.

2. Description of the Related Art

A plasma display panel (PDP) is used in a plasma display device, which is one of the generally known types of flat display devices, and has two opposite substrates and discharge gas injected into a discharge space defined between the substrates. As gas discharge is performed, plasma is created and generates UV rays, which excite fluorescent substances and cause them to emit visible rays so that images can be realized. PDPs may be classified into DC-type, AC-type, and hybrid-type panels according to their structure and driving principle. In addition, PDPs may be classified into surface discharge-type and opposite discharge-type panels according to their discharge structure. Currently, AC-type three-pole surface-discharge plasma panels are widely used.

Conventional PDPs generally include a front substrate, a rear substrate opposing the front substrate, and electrodes for initiating discharge.

The front substrate is typically made of glass, for example, transparent soda glass, with a thickness of about 2.8 mm and transmits visible rays which are created by fluorescent substances. The front substrate has a pair of first display (Y) electrodes and second display (X) electrodes positioned on its lower surface so that sustain discharge can occur. The transparent electrodes are made of indium tin oxide (ITO) and have bus electrodes positioned below them. The bus electrodes have a width smaller than that of the transparent electrodes and compensate for line resistance thereof. A front panel has a dielectric substance layer formed on a lower surface of the front substrate so that the transparent electrodes are embedded without being exposed and a protective layer for protecting the dielectric substance layer.

The rear substrate has address (A) electrodes positioned on its upper surface, which opposes the front substrate, while having the address electrodes direction intersecting with the transparent electrodes direction of the front substrate. The rear substrate has a dielectric substance layer formed on its upper surface so that the address electrodes are not exposed, as in the case of the front substrate. The rear substrate has barriers formed on its upper surface to maintain discharge distance and avoid electro-optical crosstalk between discharge cells. Particularly, the barriers are positioned between the front and rear substrates and delimit discharge cells, which function as places for generating discharge and which are the smallest components of pixels that are basic units for realizing images in PDPs. Fluorescent substances of red (R), green (G), and blue (B) are applied to both surfaces of the barriers, which constitute discharge cells, and to the upper surface of the dielectric substance layer of the rear substrate, which has no barrier formed thereon, to define unit pixels.

PDPs, constructed as above, adjust the number of sustain discharges in accordance with transmitted video data and realize gray scale necessary to display images. In order to express such gray scale, an Address and Display period Separated (ADS) mode is generally used wherein a field is divided into a number of sub-fields having different numbers of discharge to be driven. In the ADS mode, each sub-field is again divided into a reset period for uniformly generating discharge, an address period for selecting a discharge cell, and a sustain period for expressing gray scale in accordance with the number of discharges.

In the address period of the sub-field, address discharge is generated by the difference between an address voltage applied to address (A) electrodes positioned below discharge cells, which have been selected to generate discharge, and a ground voltage successively applied to first display (Y) electrodes. A positive address voltage is applied to those of the address electrodes, which are positioned below discharge cells that have been selected to emit light, while ground voltage is applied to other address electrodes. When display data signals of the positive address voltage are applied while scanning pulses of the ground voltage are applied, corresponding discharge cells accumulate wall discharge by means of address discharge, while other discharge cells do not. Second display (X) electrodes maintain a predetermined voltage for more efficient address discharge during the address period. The amount of address voltage necessary for address discharge affects optical efficiency, structure, and material selection of PDPs. Particularly, the larger the address voltage is, the more power is consumed. As a result, optical efficiency decreases, sputtering increases between dielectric substance layers of front and rear substrates, and movement of charged particles to adjacent discharge cells via barriers (i.e. crosstalk) increases. Therefore, it is generally advantageous to have a low address discharge initiation voltage.

In the case of a three-electrode surface-discharge mode, the distance between first display electrodes and address electrodes is large and a higher discharge voltage is necessary. In addition, initial discharge occurs in a region where both electrodes are closest to each other (i.e. near the center of discharge cells), and following discharge shifts towards a boundary region of the electrodes. The reason discharge occurs in the central region is that this region has a lower discharge initiation voltage. Once discharge is initiated, spatial charges are established and the discharge is maintained under a voltage which is lower than the discharge initiation voltage. The voltage between both electrodes gradually decreases as time elapses. After discharge is initiated, ions and electrons accumulate in the central region and the intensity of electrical fields weakens. As a result, discharge disappears from this region. In the three-electrode surface-discharge structure, first display (Y) electrodes and second display (X) electrodes are positioned behind the front substrate in parallel. Therefore, even when ion particles are accelerated by electrical fields, which are established by electrical potential applied to the first display electrodes and second display electrodes, collide with discharge gas, and generate discharge during sustain discharge, the ion particles are very unlikely to collide with the discharge gas, because they travel along a short path, which is limited to a predetermined range behind the front substrate. In addition, discharge is concentrated in a space within the discharge cells and efficiency of the plasma display panel degrades.

In an attempt to improve the three-electrode surface-discharge mode, PDPs of an opposite discharge mode have recently been developed. In the opposite discharge mode, first display electrodes and second display electrodes are formed in a space between front and rear substrates by barriers while opposing each other and having a direction which intersects with the address electrodes' direction. Since the distance between the first display electrodes and the address electrodes is smaller than in the case of the surface-discharge mode, the address voltage is lower. In addition, discharge occurs in the whole interior of discharge cells. This means that discharge space increases and discharge efficiency improves.

In the opposite discharge mode, barriers are generally formed on front and rear panels in a closed type. This increases fluorescent substance application area and improves visible ray conversion efficiency. However, the discharge distance between first display electrodes and address electrodes increases and the address voltage rises. In addition, the distance between electrodes undergoing discharge varies depending on the distance (i.e., cell pitch) between barriers on which they are formed. In the case of long-gap discharge, the voltage of sustain discharge rises.

SUMMARY OF THE INVENTION

In accordance with the present invention a plasma display panel is provided including first display electrodes and second display electrodes formed on barriers formed in a space between front and rear substrates. Closed-type barriers are formed behind the front substrate, and stripe-type barriers are formed before the rear substrate to reduce the gap between the first display electrodes and address electrodes and decrease address voltage. The plasma display panel uses trigger discharge by applying multi-step pulses during sustain discharge to lower sustain discharge voltage and improve emission efficiency.

There is also provided a plasma display panel including a first substrate and a second substrate opposing the first substrate. A rear barrier layer is formed on the first substrate between the first substrate and the second substrate and have first barriers positioned in a predetermined direction while being substantially parallel to one another, the rear barrier layer delimiting a plurality of discharge cells. A first fluorescent substance layer is formed inside the discharge cells delimited by the rear barrier layer. A plurality of address electrodes are positioned beneath the first fluorescent substance layer while being substantially parallel to the first barriers. A front barrier layer is formed beneath the second substrate to delimit a number of discharge cells together with the rear barrier layer. First display electrodes and second display electrodes are formed inside the front barrier layer while alternating with each other and having a direction intersecting with the direction of the address electrodes. The front barrier layer may have closed second barriers to delimit discharge cells and third barriers formed beneath the closed second barriers while corresponding to the second barriers to delimit discharge cells, the first display electrodes and second display electrodes being positioned inside the third barriers.

The second and third barriers may have a sectional shape selected from a square, a hexagon, and a circle, the sectional shape being taken in a direction substantially parallel to the front substrate.

The front barrier layer may have second barriers formed in a shape corresponding to a shape of the rear barrier layer while being substantially parallel to one another and closed third barriers formed beneath the second barriers to delimit discharge cells, the first display electrodes and second display electrodes being positioned inside the third barriers. The third barriers may have a sectional shape selected from a square, a hexagon, and a circle, the sectional shape being taken in a direction substantially parallel to the front substrate.

The second barriers may have a second fluorescent substance layer formed on a surface thereof. The second fluorescent substance layer may be made of a transmissive fluorescent substance.

The third barriers may have a third fluorescent substance formed on a surface thereof. The third fluorescent substance layer may be made of a reflective fluorescent substance.

The first fluorescent substance layer may be made of a reflective fluorescent substance. The first display electrodes and second display electrodes may be spaced substantially the same distance from the front substrate while facing each other.

The first display electrodes and second display electrodes may be formed as metal electrodes. The metal electrodes may be made of a material selected from silver (Ag), copper (Cu), and chromium (Cr).

The second barriers may be made of a dielectric substance. The dielectric substance may have filler made of one selected from zirconium oxide ($ZrO_2$), titanium oxide ($TiO_2$), and aluminum oxide ($Al_2O_3$) and pigment made of any one selected from chromium (Cr), copper (Cu), and cobalt (Co).

The plasma display panel may be driven by a driving signal having a reset period, an address period, and a sustain discharge period. Scan pulses may be applied to the first display electrodes in the address period such that negative first voltages and negative second voltages having an amplitude larger than an amplitude of the first voltages alternate with each other. Sustain pulses may be applied to the second display electrodes while being biased with a predetermined positive voltage. Trigger discharge may occur between the first display electrodes and the address electrodes while the first voltages are applied and main discharge may occur between the first display electrodes and the second display electrodes while the second voltages are applied. The scan pulses may be applied such that, in a voltage rising period, the first voltages and the second voltages alternate with each other and, in a voltage falling period, drop occurs from the second voltages to ground voltage.

The plasma display panel may be driven by a driving signal having a reset period, an address period, and a sustain discharge period and sustain pulses may be alternately applied to the first display electrodes and second display electrodes in the sustain discharge period such that positive third voltages and positive fourth voltages having an amplitude larger than an amplitude of the third voltages alternate with each other. Trigger discharge may occur between any one of the first display electrodes and second display electrodes and the address electrodes while the third voltages are applied and main discharge may occur between the first display electrodes and the second display electrodes while the fourth voltages are applied.

The sustain pulses may be applied such that, in a voltage rising period, the third voltages and the fourth voltages alternate with each other and, in a voltage falling period, the fourth and third voltages alternate with each other, the voltage rising period and the voltage falling period being linearly symmetric to each other.

DETAILED DESCRIPTION

Figure 1:
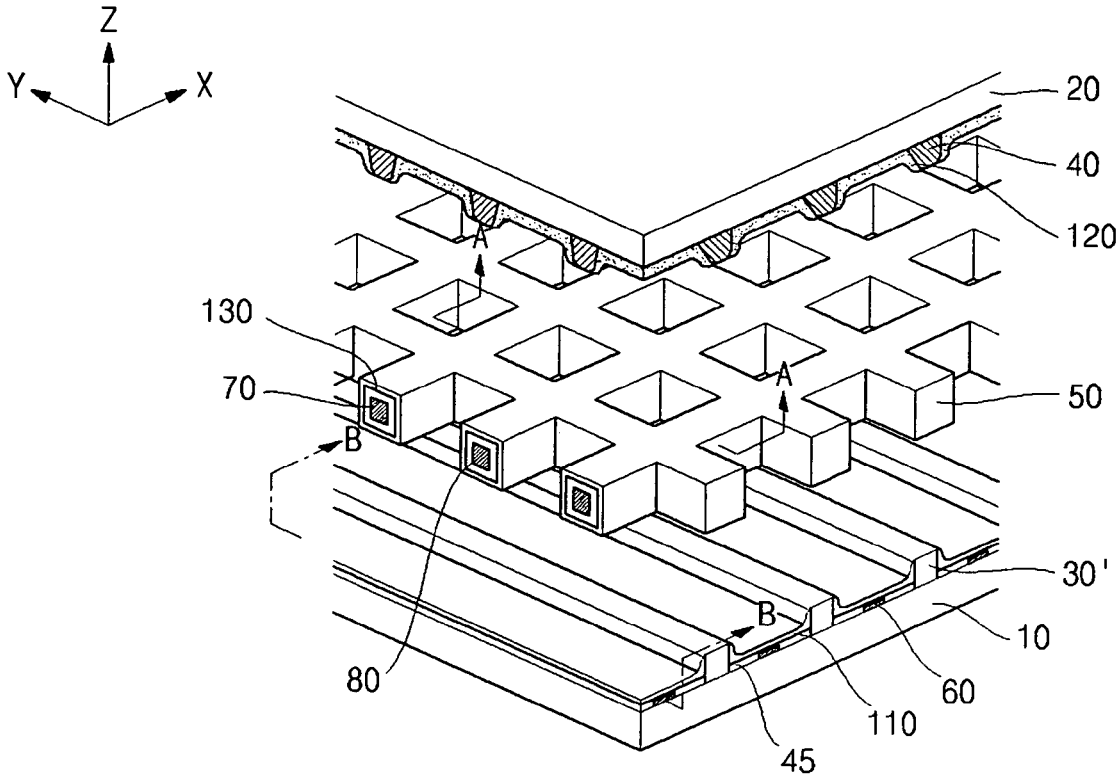
FIG. 1 is a partially-broken perspective view showing a plasma display panel according to a first embodiment of the present invention.
Figure 2:
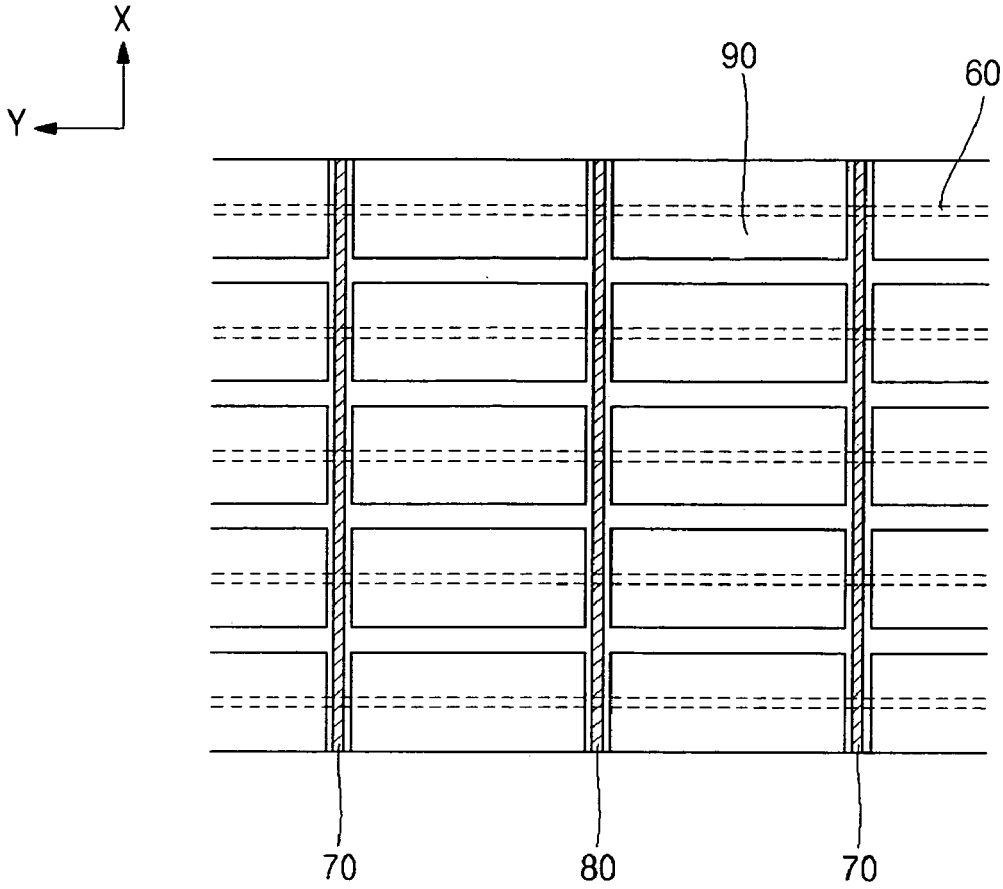
FIG. 2 is a horizontal sectional view taken along line A-A of FIG. 1.
Figure 3A:
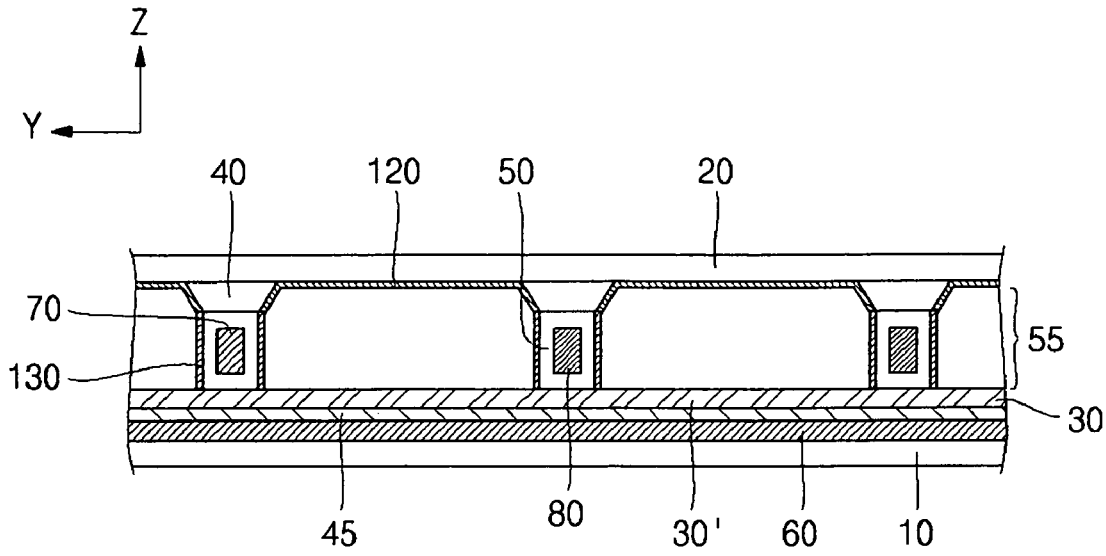
FIG. 3*a* is a vertical sectional view taken along line B-B of FIG. 1.
Figure 3B:
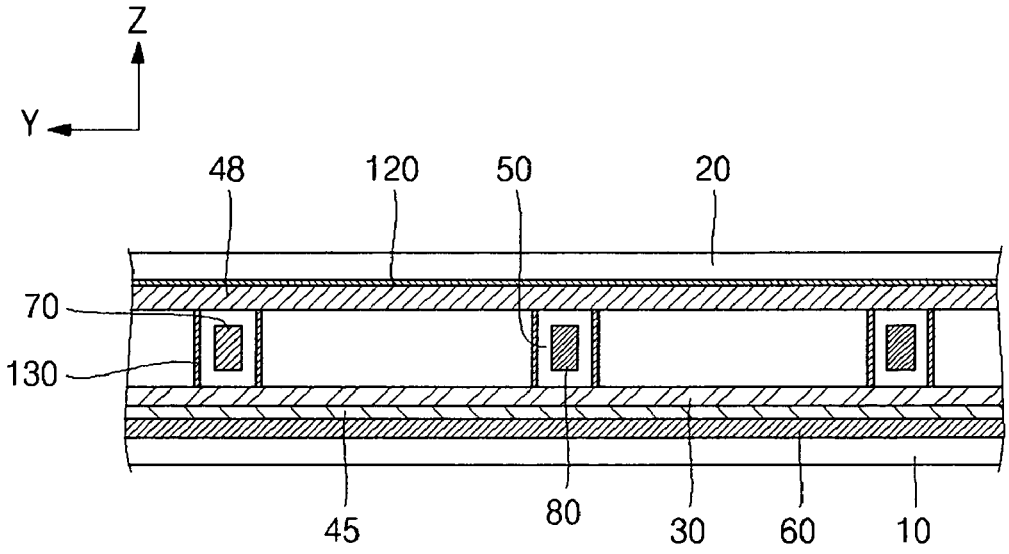
FIG. 3*b* is a vertical sectional view showing a plasma display panel according to a second embodiment of the present invention.

A plasma display panel according to a first embodiment of the present invention, referring to FIGS. 1, 2 and 3*a*, includes a first substrate (hereinafter, referred to as rear substrate) 10, a second substrate (hereinafter, referred to as front substrate) 20, a rear barrier layer 30, a front barrier layer 55, first display (Y) electrodes 70, second display (X) electrodes 80, and address (A) electrodes 60. The rear barrier layer 30 includes first barriers 30' and delimits a number of discharge cells 90. The front barrier layer 55 includes second barriers 40 and third barriers 50. First, second, and third fluorescent substance layers 110, 120, 130 are formed on the first, second, and third barriers 30', 40, 50, respectively. The discharge cells 90 are provided with fluorescent substance layers for absorbing vacuum UV rays and emitting visible rays and are filled with discharge gas for generating vacuum UV rays by means of plasma discharge.

The rear substrate 10 is made of a predetermined material (e.g. glass) with a predetermined thickness and constitutes a plasma display panel together with the front substrate 20. The rear substrate 10 includes address electrodes 60 positioned in a predetermined direction on its upper surface, which opposes the front substrate 20, a first dielectric substance layer 45 applied so as to cover the address electrodes 60, and a rear barrier layer 30 (including first barriers 30') formed on top of the first dielectric substance layer 45. The rear barrier layer 30 may be solely composed of first barriers 30'. Alternatively, the rear barrier layer 30 may include another barrier layer in addition to first barriers 30'. A first fluorescent substance layer 110 is formed on the rear barrier layer 30. In the following description, surfaces of components facing the front substrate 20 (i.e. +z direction in FIG. 1) will be defined as upper surfaces and those facing the rear substrate 10 (i.e. −z direction in FIG. 1) will be defined as lower surfaces.

The front substrate 20 is made of a transparent material (e.g. soda glass) and is positioned to oppose the rear substrate 10. The front substrate 20 has a front barrier layer 55 formed on its lower surface.

The rear barrier layer 30 has a plurality of barriers 30' positioned therein in a predetermined direction (y direction in FIG. 1) while being substantially parallel to one another. Particularly, the rear barrier layer 30 is of a stripe type, which is open in a direction (y direction in FIG. 1) and closed in another direction (x direction in FIG. 1). In an opposite discharge structure as in the present invention, address discharge is initiated between lower portions of the first display electrodes 70 and upper portions of the address electrodes 60. Specifically, discharges occur first in regions where both electrodes are adjacent to each other and then spreads towards farther regions. If the first barriers 30' constituting the rear barrier layer 30 are of a closed type, application area of fluorescent substances increases and conversion efficiency into visible rays improves using the same UV generation efficiency. However, closed barriers increase the distance between lower portions of the first display electrodes and upper portions of the address electrodes. As a result, address discharge voltage increases and price of address driving circuits rises. Therefore, the present invention uses stripe-type barriers, instead of closed-type barriers which raise address discharge voltage, to lower address discharge voltage and reduce cost for address driving circuits.

The rear barrier layer 30 delimits a number of discharge cells 90, which act as places for generating discharge together with the rear substrate 10, the front substrate 20, and the front barrier layer 55. The first barriers 30' are positioned substantially parallel to one another about the discharge cells 90 and have address electrodes 60 positioned therein while being substantially parallel to one another. The rear barrier layer 30 is made of glass including elements, such as Pb, B, Si, Al, and O. In an exemplary embodiment, the rear barrier layer 30 is made of a dielectric substance including filler, such as zirconium oxide ($ZrO_2$), titanium oxide ($TiO_2$), or aluminum oxide ($Al_2O_3$), and pigment, such as chromium (Cr), copper (Cu), cobalt (Co), or iron (Fe). However, the composition of the rear barrier layer 30 is not limited to that herein, and other dielectric substances may be used. The rear barrier layer 30 facilitates discharge of the address electrodes 60 positioned therein and prevents them from being damaged due to collision with charged particles which are accelerated during discharge.

The front barrier layer 55, according to a first embodiment of the present invention, includes closed-type second barriers 40 for delimiting discharge cells 90 and closed-type third barriers 50 corresponding to the second barriers 40 to delimit discharge cells 90 with the first display electrodes and second display electrodes 70, 80 positioned therein. In contrast to the stripe-type rear barrier layer 30, the front barrier layer 55 is of a closed-type. In a closed-type barrier structure, fluorescent substances can be applied in a larger area than in the case of a stripe-type barrier structure. This means that the closed-type barrier structure has better emission efficiency than the stripe-type barrier structure, provided that the electrode structure is the same. By adopting a closed-type barrier structure of various shapes, therefore, the front barrier layer 55 has a large fluorescent substance application area and realizes high visible ray conversion efficiency. The front barrier layer 55 delimits discharge cells 90 together with the rear barrier layer 30, when the rear substrate 10 is coupled to the front substrate 20. The front barrier layer 55 may be formed as a single unit with the front substrate 20 by etching it. Alternatively, the front barrier layer 55 may be separately formed using a barrier material. The front barrier layer 55 may be made of a dielectric substance, as in the case of the rear barrier layer 30. In this case, the front barrier layer 55 may have a protective layer formed on its outer surface using magnesium oxide (MgO).

The second barriers 40 are positioned on the lower surface of the front substrate 20 while making contact with it. A second fluorescent substance layer 120 is formed on the outer surface of the second barriers 40 and on parts of the front substrate 20 having no second barrier 40 formed thereon. According to the first embodiment of the present invention, the second barriers 40 are of a closed type. According to a second embodiment of the present invention, however, the second barriers may be of a stripe-type. Particularly, the second barrier 48 may be formed substantially parallel to y-axis direction in a shape corresponding to that of the first barriers 30.

The third barriers 50 are formed on the lower surface of the second barriers 40 while contacting them. The third barriers 50 constitute the front barrier layer 55 together with the second barriers 40. The first display electrodes and second display electrodes 70, 80 are positioned inside the third barriers 50. The third barriers 50 have a third fluorescent substance layer 130 formed on lateral surfaces thereof. The second and third barriers 40, 50 may be formed in a direction substantially parallel to the front substrate 20 in a sectional shape selected from a square, a hexagon, and a circle, but the shape is not limited to that herein.

The first display electrodes and second display electrodes 70, 80 are positioned inside the third barriers 50 while alternating with each other about the discharge cells 90 and are shaped by adjacent discharge cells 90, respectively. The first display electrodes and second display electrodes 70, 80 are positioned in a direction (x direction in FIG. 1) perpendicular to the first barriers 30', which constitute the rear barrier layer 30, while being substantially parallel to each other. Particularly, the first display electrodes and second display electrodes 70, 80 constitute pairs while opposing each other about the discharge cells 90, respectively, and conduct discharge. Therefore, the first display electrodes and second display electrodes 70, 80 may be spaced substantially the same distance from the front substrate 20 while facing each other.

The first display electrodes and second display electrodes 70, 80 may be made of conventional conductive metal, because they are positioned inside the third barriers 50 and have no need for transparency. In an exemplary embodiment, the first display electrodes and second display electrodes 70, 80 are made of a metallic material having excellent conductivity and low resistance, such as silver (Ag), aluminum (Al), or copper (Cu), in order to obtain fast response rate to discharge, avoid signal distortion, and decrease power consumption necessary for sustain discharge. However, material of the first display electrodes and second display electrodes 70, 80 is not limited to that herein, and any metal having excellent conductivity and low resistance may be used.

The address electrodes 60 intersect with the first display electrodes and second display electrodes 70, 80 while being insulated from them. The address electrodes 60 are positioned on the rear substrate 10 while being substantially parallel to one another. In an exemplary embodiment, the address electrodes 60 approximately pass through the lower center of the discharge cells 90. The address electrodes 60 are entirely covered with the first dielectric substance layer 45. Particularly, the first dielectric substance layer 45 is positioned on the entire upper surface of the rear substrate 10 to cover the address electrodes 60. The first dielectric substance layer 45 facilitates discharge of the address electrodes 60 positioned on the upper surface of the rear substrate 10 and prevents them from being damaged due to collision with charged particles which are accelerated during discharge.

The fluorescent substance layers 110, 120, 130 include a first fluorescent substance layer 110 formed on the lateral surfaces of the rear barrier layer 30 inside the discharge cells 90, a second fluorescent substance layer 120 formed on the lower surface of the front substrate 20 and on the lateral surfaces of the second barriers 40, and a third fluorescent substance layer 130 formed on the lateral surfaces of the third barriers. The first and third fluorescent substance layers 110, 130 absorb vacuum UV rays and generate visible rays, which are reflected towards the front substrate 20. Therefore, the first and third fluorescent substance layers 110, 130 are made of a reflective fluorescent substance. The second fluorescent substance layer 120 absorbs vacuum UV rays and transmits visible rays towards the front substrate 20. In addition, the second fluorescent substance layer 120 transmits visible rays, which are reflected by the first and third fluorescent substance layers 110, 130. In order to improve the transmissivity of visible rays towards the front substrate 20, the thickness of the second fluorescent substance layer 120, which is made of a transmissive fluorescent substance, is preferably smaller than that of the first and third fluorescent substance layers 110, 130, which are made of a reflective fluorescent substance. The transmissivity of visible rays in the second fluorescent substance layer 120 is inversely proportional to the thickness of the fluorescent substance layer. Therefore, the thickness of the second fluorescent substance layer 120 is property determined based on the emission efficiency of the discharge cells. In contrast, the first and third fluorescent substance layers 110, 130 reflect visible rays and must have a large thickness, in consideration of the emission efficiency of the discharge cells.

The fluorescent substance layers 110, 120, 130 include components for receiving UV rays and generating visible rays. Specifically, a red fluorescent substance layer formed on red emission discharge cells may include a fluorescent substance, such as $Y(V,P)O_4$:Eu, a green fluorescent substance layer formed on green emission discharge cells may includes a fluorescent substance, such as $Zn_2SiO_4$:Mn, and a blue fluorescent substance layer formed on blue emission discharge cells may include a fluorescent substance, such as BAM:Eu. As such, the fluorescent substance layers 110, 120, 130 include red, green, and blue emission substance layers, which are positioned inside adjacent discharge cells 90, respectively. Therefore, adjacent discharge cells 90 are combined to constitute a unit pixel with red, green, and blue emission fluorescent layers formed thereon, respectively, and realize color images.

The discharge cells 90 are delimited by the first dielectric substance layer 45 on the upper surface of the rear substrate 10, the rear barrier layer 30, the front barrier layer 55, and the front substrate 20. The discharge cells 90 are filled with discharge gas, e.g. mixture gas including xenon (Xe) and neon (Ne), to generate plasma discharge therein. The discharge cells 90 have fluorescent substance layers 110, 120, 130 formed in predetermined regions thereof to absorb UV rays and emit visible rays, as mentioned above. The width or length of the discharge cells 90 may vary depending on the emission efficiency of the respective fluorescent substance layers. The discharge cells 90 have electrodes positioned on their central and lower portions to conduct address discharge and sustain discharge.

A discharge process of a plasma display panel according to the present invention will now be described.

Figure 4:
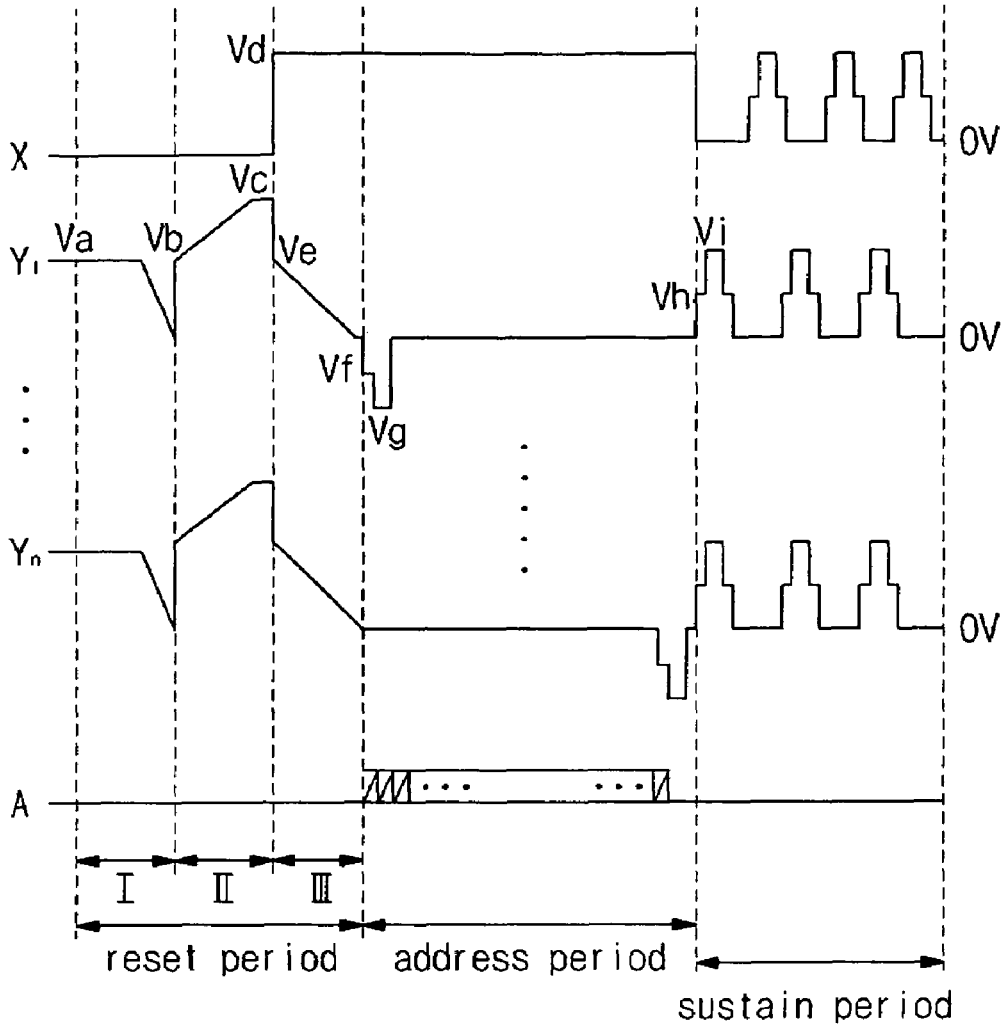
FIG. 4 shows driving waves in a discharge process of a plasma display panel according to embodiments of the present invention.

FIG. 4 shows driving waves in a discharge process of a plasma display panel according to an embodiment of the present invention. FIGS. 5*a* to 5*g* show the distribution of wall charges based on driving waves according to embodiments of the present invention, respectively. Hereinafter, address electrodes will be referred to as A electrodes, first display electrodes as Y electrodes, and second display electrodes as X electrodes.

In a driving method according to an embodiment of the present invention, as shown in FIG. 4, each sub-field includes a reset period, an address period, and a sustain period. The reset period is divided into an erasing period I, a Y electrode rising wave period II, and a Y electrode falling wave period III.

Figure 5A:
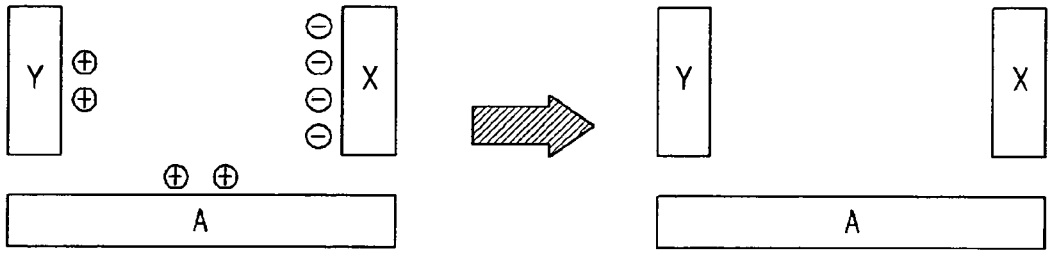
FIGS. 5*a*, 5*b*, 5*c*, 5*d*, 5*e*, 5*f* and 5*g* show the distribution of wall charges based on driving waves according to embodiments of the present invention, respectively.

In the erasing period I, wall charges, which have been formed in a previous sustain discharge period, are erased. It is assumed in the present embodiment that sustain discharge voltage pulses are applied to the X electrodes near the end of the sustain discharge period, and a lower voltage (e.g. ground voltage) is applied to the Y electrodes than is applied to the X electrodes. Then, (+) wall charges are formed on the Y and A electrodes and (−) wall charges are formed on the X electrodes, as shown in FIG. 5*a*.

In the erasing period I, ramp waves, which gradually fall from voltage $V_a$ to ground voltage, are applied to the Y electrodes while biasing the X and A electrodes with ground voltage. Then, wall charges, which have been formed in the sustain discharge period, are erased.

Figure 5B:
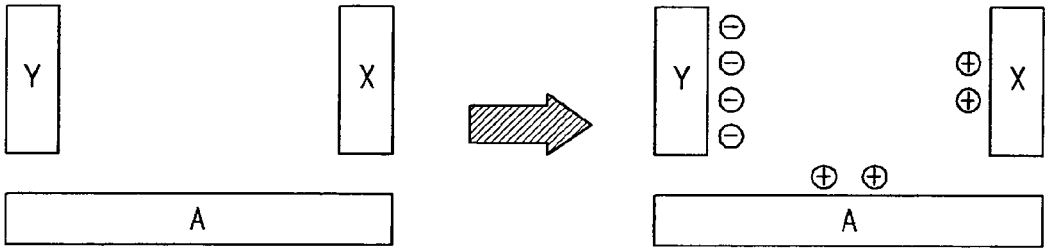

In the Y electrode rising wave period II, ramp waves, which gradually rise from voltage $V_b$ to voltage $V_c$, are applied to the Y electrodes while biasing the X and A electrodes with ground voltage. Slight reset discharge occurs in every discharge cell from the Y electrodes to the A and X electrodes, respectively, while the rising waves are applied. Then, (−) wall charges are formed on the Y electrodes and (+) wall charges are formed on the A and X electrodes, as shown in FIG. 5*b*.

Figure 5C:
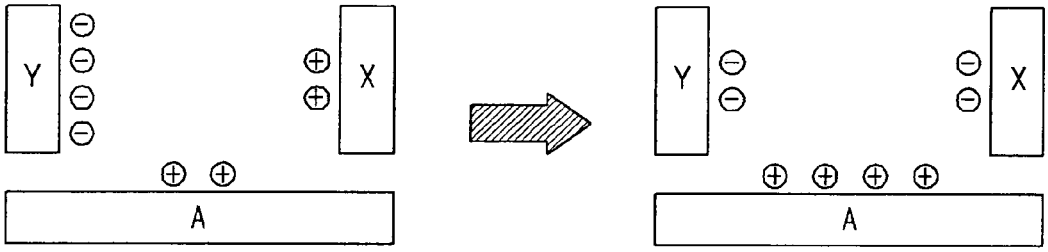

In the Y electrode falling wave period III, ramp waves, which gradually fall from voltage $V_e$ to ground voltage, are applied to the Y electrodes while biasing the X and A electrodes with voltage $V_d$ and ground voltage, respectively. Setup of $V_b$=$V_e$ is advantageous for simplifying circuit construction, but this feature is not always necessary. Slight reset discharge occurs in every discharge cell while the ramp waves fall. The Y electrode falling wave period is aimed to gradually reduce wall charges, which have accumulated in the Y electrode rising wave period. Therefore, the longer the falling wave time is (i.e. gentler the slope is), the better for address discharge, because reduction in wall charges can be controlled more precisely. As a result of applying falling waves to the Y electrodes, wall charged are uniformed erased, which have accumulated on the respective electrodes of entire cells. Then, (+) wall charges are formed on the A electrodes and (−) wall charges are formed on the Y and X electrodes, as shown in FIG. 5*c*.

Figure 5D:
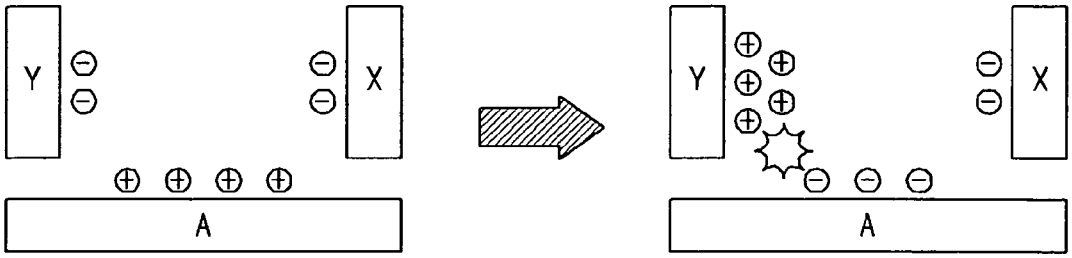
Figure 5E:
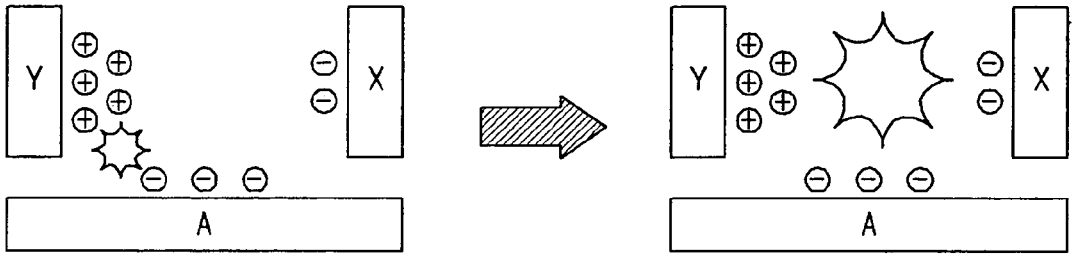

In the address period, a scan voltage is successively applied to the Y electrodes to apply scan pulses while biasing a number of X electrodes with voltage $V_d$. In the A electrodes, an address voltage is applied to cells which need discharge. The scan pulses applied to the first display electrodes include negative first voltages $V_f$ and negative second voltages $V_g$ having an amplitude larger than that of the first voltages $V_f$ and alternating with them at a predetermined interval. When the first voltages $V_f$ are applied, as shown in FIG. 5*d*, trigger discharge occurs between the Y electrodes of $V_f$ and the A electrodes of $V_1$. When the second voltages $V_g$ are applied, as shown in FIG. 5*e*, main discharge occurs between the Y electrodes of $V_g$ and the X electrodes of $V_d$. This is because the distance between the Y and A electrodes is much smaller than that between the Y and X electrodes, and the electrical field applied between the Y and A electrodes is much stronger than between the latter. Therefore, trigger discharge occurring between $V_f$ applied to the Y electrodes and $V_1$ applied to the A electrodes plays a pivotal role while the first voltages $V_f$ are applied to the Y electrodes. When the second voltages $V_g$ are applied to the Y electrodes, already-occurred trigger discharge is dispersed and main discharge occurs between $V_g$ applied to the Y electrodes and $V_d$ applied to the X electrodes.

In the address period, scan pulses are applied such that the first voltages and the second voltages $V_f$, $V_g$ are successively applied only in the voltage rising period, and the second voltages $V_g$ fall to ground voltage in the voltage falling period. This is for the purpose of minimizing the address period and increasing the sustain period for luminance improvement.

Figure 5F:
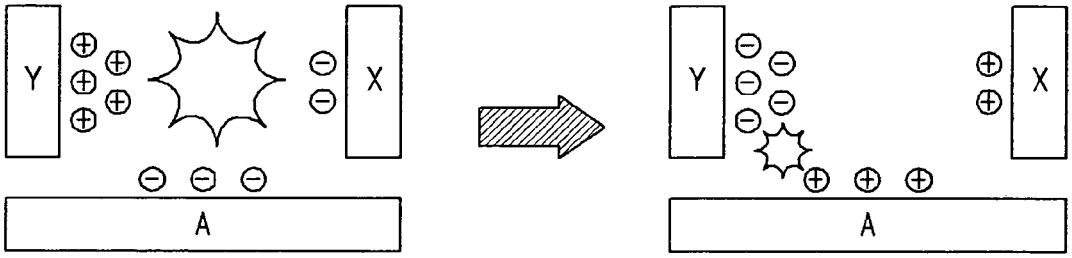
Figure 5G:
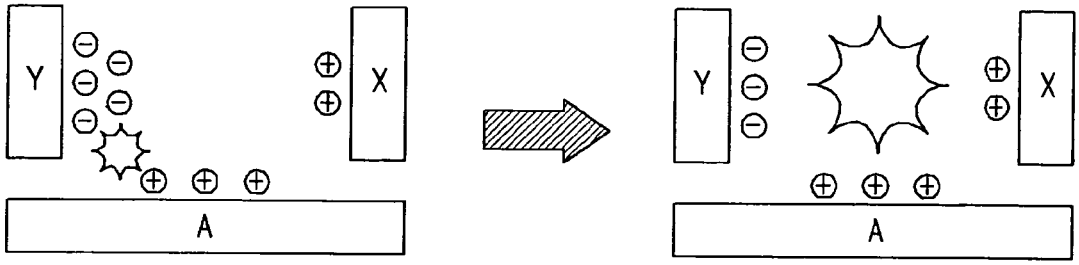

In the sustain period, sustain pulses are alternately applied to the Y and X electrodes while biasing a number of A electrodes with ground voltage. Specifically, positive third voltages $V_h$ and positive fourth voltages $V_i$ having an amplitude larger than the third voltages alternative with each other at a predetermined interval. When the third voltages $V_h$ are applied, as shown in FIG. 5*f*, trigger discharge occurs between the Y electrodes ($V_h$) and the A electrodes (ground voltage). When the fourth voltages $V_i$ are applied, as shown in FIG. 5*g*, main discharge occurs between the Y electrodes ($V_i$) and the X electrodes (ground voltage). This is because the distance between the Y and A electrodes is much smaller than that between the Y and X electrodes, and the electrical field applied between the Y and A electrodes is much stronger than between the latter. Therefore, trigger discharge occurring between $V_h$ applied to the Y electrodes and ground voltage applied to the A electrodes plays a pivotal role while the third voltages $V_h$ are applied to the Y electrodes. When the fourth voltages $V_i$ are applied to the Y electrodes, already-occurred trigger discharge is dispersed and main discharge occurs between $V_i$ applied to the Y electrodes and ground voltage applied to the X electrodes.

In the sustain period, sustain pulses may be applied such that, in the voltage rising period, the third voltages and the fourth voltages $V_h$, $V_i$ are successively applied and, in the voltage falling period, the fourth voltages and the third voltages $V_i$, $V_h$ are successively applied, in contrast to the address period, so that the voltage rising period are linearly symmetric to the voltage falling period.

According to the present embodiment, discharge is performed such that, in early stages of the address and sustain periods, trigger discharge occurs between the Y and A electrodes so that discharge can be conducted even if initial particle number is small and, in a normal condition, main discharge occurs between the Y and X electrodes for stable discharge.

The plasma display panel according to the present invention is advantageous in that stripe-type barriers are formed on the upper portion of the rear substrate in an opposite discharge structure to reduce the distance between the first display electrodes and the address electrodes and lower the address discharge voltage. In addition, mufti-stage pulses are applied in the address and sustain periods to utilize trigger discharge and lower the sustain discharge voltage. This saves power consumption and improves emission efficiency.

The present invention can use semiconductor devices having low nominal voltage to reduce manufacturing cost.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A plasma display panel comprising:

a first substrate;

a second substrate opposing the first substrate;

a rear barrier layer on the first substrate between the first substrate and the second substrate and having first barriers extending in a first direction and being substantially parallel to one another, the rear barrier layer delimiting a plurality of discharge cells;

a first fluorescent substance layer inside discharge cells of the plurality of discharge cells delimited by the rear barrier layer;

a plurality of address electrodes positioned between the first fluorescent substance layer and the first substrate and being substantially parallel to the first barriers;

a front barrier layer between the second substrate and the rear barrier layer and delimiting the plurality of discharge cells together with the rear barrier layer; and first display electrodes and second display electrodes alternating with each other inside the front barrier layer and extending in a second direction crossing the first direction, wherein the front barrier layer comprises second barriers formed in a shape corresponding to a shape of the rear barrier layer and being substantially parallel to one another and closed third barriers between the second barriers and the rear barrier layer, the first display electrodes and the second display electrodes being inside the closed third barriers, and wherein the closed third barriers have a second fluorescent substance on a surface thereof.

2. The plasma display panel as claimed in claim 1, wherein the closed third barriers have a sectional shape selected from a square, a hexagon, and a circle, the sectional shape being taken in a direction substantially parallel to the second substrate.

3. A plasma display panel comprising:

a first substrate;

a second substrate opposing the first substrate;

a rear barrier layer on the first substrate between the first substrate and the second substrate and having first barriers extending in a first direction and being substantially parallel to one another, the rear barrier layer delimiting a plurality of discharge cells;

a first fluorescent substance layer inside discharge cells of the plurality of discharge cells delimited by the rear barrier layer;

a plurality of address electrodes positioned between the first fluorescent substance layer and the first substrate and being substantially parallel to the first barriers;

a front barrier layer between the second substrate and the rear barrier layer and delimiting the plurality of discharge cells together with the rear barrier layer; and first display electrodes and second display electrodes alternating with each other inside the front barrier layer and extending in a second direction crossing the first direction, wherein the front barrier layer comprises closed second barriers and third barriers between the second barriers and the rear barrier layer and corresponding to the closed second barriers, and the first display electrodes and the second display electrodes are inside the third barriers.

4. The plasma display panel as claimed in claim 3, wherein the closed second barriers and the third barriers have a sectional shape selected from a square, a hexagon, and a circle, the sectional shape being taken in a direction substantially parallel to the second substrate.

5. The plasma display panel as claimed in claim 3, wherein the closed second barriers have a second fluorescent substance layer on a surface thereof.

6. The plasma display panel as claimed in claim 5, wherein the second fluorescent substance layer comprises a transmissive fluorescent substance.

7. The plasma display panel as claimed in claim 5, wherein the third barriers have a third fluorescent substance on a surface thereof.

8. The plasma display panel as claimed in claim 7, wherein the third fluorescent substance layer comprises a reflective fluorescent substance.

9. The plasma display panel as claimed in claim 3, wherein the first fluorescent substance layer comprises a reflective fluorescent substance.

10. The plasma display panel as claimed in claim 3, wherein the first display electrodes and the second display electrodes are spaced substantially the same distance from the second substrate while facing each other.

11. The plasma display panel as claimed in claim 3, wherein the first display electrodes and the second display electrodes comprise metal electrodes.

12. The plasma display panel as claimed in claim 11, wherein the metal electrodes comprise a material selected from silver (Ag), copper (Cu), and chromium (Cr).

13. The plasma display panel as claimed in claim 3 or 1, wherein the second barriers comprise a dielectric substance.

14. The plasma display panel as claimed in claim 13, wherein the dielectric substance comprises a filler selected from zirconium oxide ($ZrO_2$), titanium oxide ($TiO_2$), and aluminum oxide ($Al_2O_3$) and a pigment selected from chromium (Cr), copper (Cu), and cobalt (Co).

15. The plasma display panel as claimed in claim 3, wherein:

the plasma display panel is driven by a driving signal having a reset period, an address period, and a sustain discharge period;

scan pulses are applied to the first display electrodes in the address period such that negative first voltages and negative second voltages having an amplitude larger than an amplitude of the first voltages alternate with each other; and sustain pulses are applied to the second display electrodes while being biased with a predetermined positive voltage.

16. The plasma display panel as claimed in claim 15, wherein trigger discharge occurs between the first display electrodes and the address electrodes while the first voltages are applied and main discharge occurs between the first display electrodes and the second display electrodes while the second voltages are applied.

17. The plasma display panel as claimed in claim 15, wherein the scan pulses are applied such that, in a voltage rising period, the first voltages and the second voltages alternate with each other and, in a voltage falling period, a drop occurs from the second voltages to ground voltage.

18. The plasma display panel as claimed in claim 3, wherein the plasma display panel is driven by a driving signal having a reset period, an address period, and a sustain discharge period and sustain pulses are alternately applied to the first display electrodes and second display electrodes in the sustain discharge period such that positive third voltages and positive fourth voltages having an amplitude larger than an amplitude of the third voltages alternate with each other.

19. The plasma display panel as claimed in claim 18, wherein trigger discharge occurs between any one of the first display electrodes and second display electrodes and the address electrodes while the third voltages are applied and main discharge occurs between the first display electrodes and the second display electrodes while the fourth voltages are applied.

20. The plasma display panel as claimed in claim 18, wherein the sustain pulses are applied such that, in a voltage rising period, the third voltages and the fourth voltages alternate with each other and, in a voltage falling period, the fourth and third voltages alternate with each other, the voltage rising period and the voltage falling period being linearly symmetric to each other.

* * * * *